United States Patent [19]

Johannessen

[11] 4,445,247

[45] May 1, 1984

[54] WATER COLLECTING DEVICE

[76] Inventor: R. L. Johannessen, Box 7040, Richmond, Va. 23221

[21] Appl. No.: 456,578

[22] Filed: Jan. 7, 1983

[51] Int. Cl.[3] ..... E01H 1/00; A47L 11/00

[52] U.S. Cl. ..... 15/98; 15/119 A

[58] Field of Search ..... 15/98, 119 A, 230.11, 15/244 A, 52; 405/36

[56] References Cited

U.S. PATENT DOCUMENTS

| | | | |
|---|---|---|---|
| 530,689 | 12/1894 | Hitchcock | 15/52 |
| 550,971 | 12/1895 | Hoffheins | 15/52 |
| 1,369,130 | 2/1921 | Rowe | 15/52 |
| 3,079,620 | 3/1963 | Hunter | 15/119 A |
| 3,950,812 | 4/1976 | Mohr | 15/98 |
| 4,386,873 | 1/1983 | Messner et al. | 15/98 X |

FOREIGN PATENT DOCUMENTS

| | | | |
|---|---|---|---|
| 7808070 | 2/1980 | Netherlands | 15/98 |
| 459281 | 9/1968 | Switzerland | 15/98 |
| 371524 | 4/1932 | United Kingdom | 15/98 |

*Primary Examiner*—Edward L. Roberts

*Attorney, Agent, or Firm*—Norman B. Rainer

[57] ABSTRACT

An apparatus for removing water from a substantially flat ground surface is comprised of a rolling carriage carrying a horizontally disposed collecting vessel enveloped by a perforated rigid cylindrical drum that supports a resilient absorbent material. The drum is adapted to rotate about the collecting vessel. At the lower extremity of the drum, the absorbent material takes up water. At the upper extremity of the drum, a squeeze roll acting against the drum expresses water from the absorbent material. The expressed water falls into the collecting vessel. A handle is pivotably associated with the carriage. When in its lowermost position, the handle causes disengagement of the squeeze roll from the drum.

6 Claims, 3 Drawing Figures

WATER COLLECTING DEVICE

BACKGROUND OF THE INVENTION

This invention concerns a device useful in removing water from flat hard-surfaced ground areas such as tennis courts, and more particularly relates to a device adapted for manually propelled rolling traversal of a paved substantially flat ground surface to effect removal of water therefrom.

Outdoor playing surfaces such as tennis courts, basketball courts, shuffleboard courts, volleyball courts, and the like are frequently paved with asphalt, concrete or other materials to form a substantially flat, hard, double surface. Despite the best efforts of construction, perfect flatness is rarely achieved. Consequently, rainfall causes pools of water to collect upon the playing surface.

The various types of apparatus earlier disclosed for removing water from hard-surfaced areas involve principles such as: (1) pushing the water off the playing area using squeegee-type appliances, (2) collecting the water for disposition at a remote site, and (3) spreading the pools of water into thin layers amenable to rapid evaporation. Devices of the collecting type generally utilize a sponge-like absorbent or a vacuum effect to lift the water off the surface and transport it to a confining receptacle for subsequent disposal.

The collecting-type devices of the prior art are however generally designed to operate in one direction of traversal across the playing surface, thereby necessitating a turning maneuver at the end of each traversal of the playing surface. The turning maneuver is not only time-consuming, but causes abrasive degradation of the absorbent material riding in contact with the playing surface. Such devices also utilize confining receptacles which tend to lose water due to wave motion therein caused by rapid movement and directional changes of the water-collecting apparatus. The emptying of the receptacle in certain designs of water-collecting device is made difficult by poor accessibility of drain means.

It is accordingly an object of the present invention to provide a water-collecting device adapted to be manually propelled in rolling motion across a hard-surfaced ground area to remove water therefrom.

It is another object of this invention to provide a device as in the foregoing object which collects water in a receptacle for facile disposal, and also distributes water upon said ground area for enhanced evaporation.

It is a further object of this invention to provide a device of the aforesaid nature capable of being operatively propelled in forward and backward directions.

It is still another object of this invention to provide a device of the aforesaid nature of light weight having a large water-holding capacity, and of compact design for ease of storage.

It is a still further object of the present invention to provide a device of the aforesaid nature of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved device for removing water from a substantially flat ground surface which comprises (a) carriage means comprised of paired, spaced-apart side members each supporting two caster wheels in horizontally spaced-apart juxtaposition, handle means pivotably engaging each side member, and a transverse member interconnecting said side members in a manner such that said caster wheels, four in total in a rectangular array, are disposed to ride upon the same plane, (b) an elongated collecting vessel extending between said side members and having a configuration which is substantially symmetrical about a vertical plane containing the axis of elongation of said vessel, said vessel having an upwardly disposed collecting opening which funnels down to a narrowed throat region at the entrance to the interior of said vessel, (c) at least three idler rollers associated with each side member in a circular locus in planes perpendicular to the axis of elongation of said collecting vessel, (d) a perforated rigid circular cylindrical drum rotatively mounted upon said idler rollers and enveloping said collecting vessel, (e) a porous resilient absorbent material of substantially uniform thickness releasably attached to the outer periphery of said drum, and positioned to ride upon substantially the same plane as said caster wheels, (f) an elongated squeeze roll rotatively supported by said side members in a position above said absorbent material, the axis of said squeeze roll being within the plane of symmetry of said vessel and parallel to the axis of elongation of said vessel, and (g) means interactive with said handle means to cause vertical movement of said squeeze roll, thereby causing said squeeze roll to either engage said absorbent material in a manner to exert compressive force thereupon, or disengage said absorbent material, (h) whereby, rolling moving of the device enables said absorbent material to take up water from said ground surface, and the compressive action of the squeeze roll displaces water from said absorbent material, causing said displaced water to flow by gravity into said collecting vessel.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
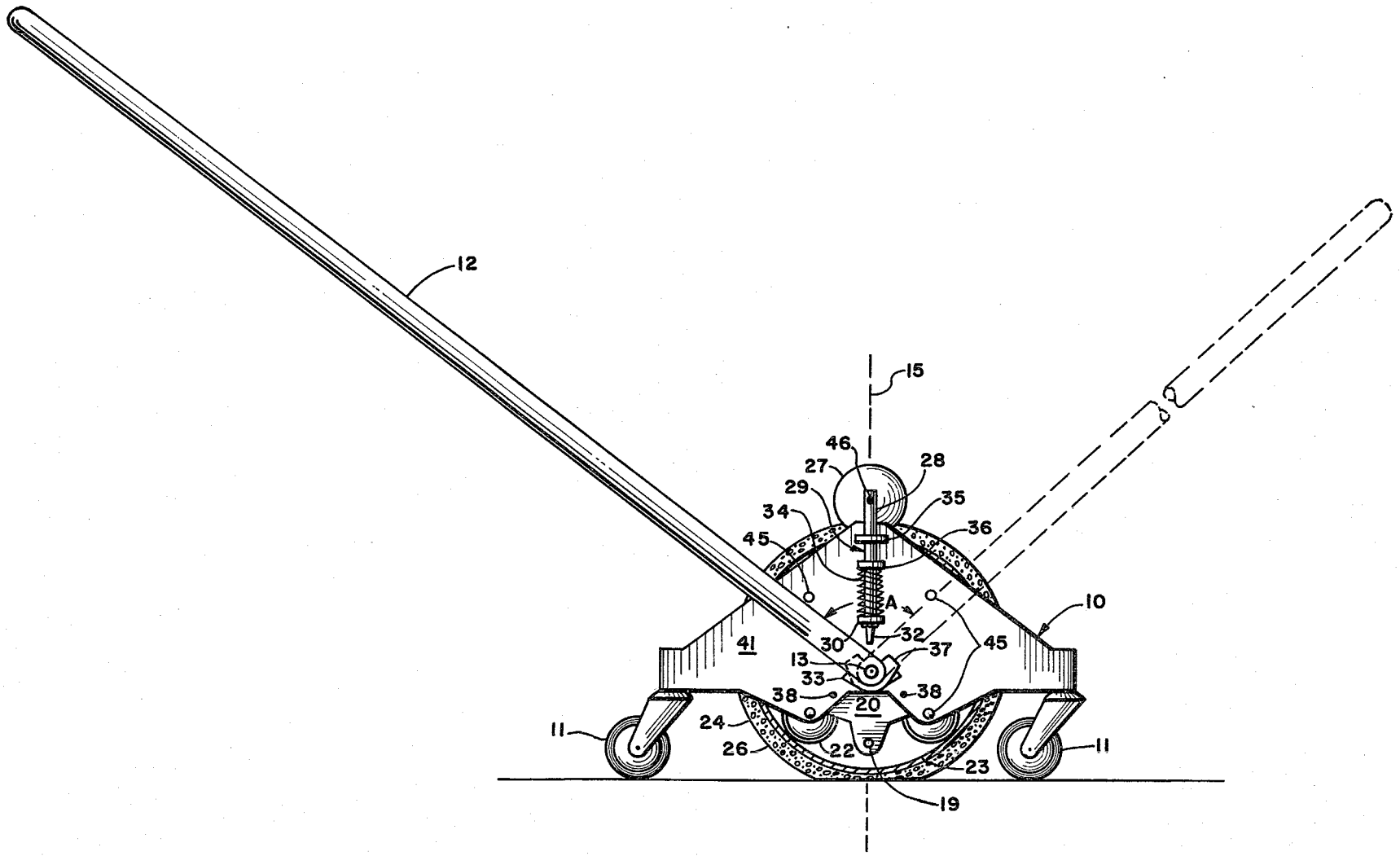
FIG. 1 is a side view of an embodiment of the water-collecting device of this invention.
Figure 2:
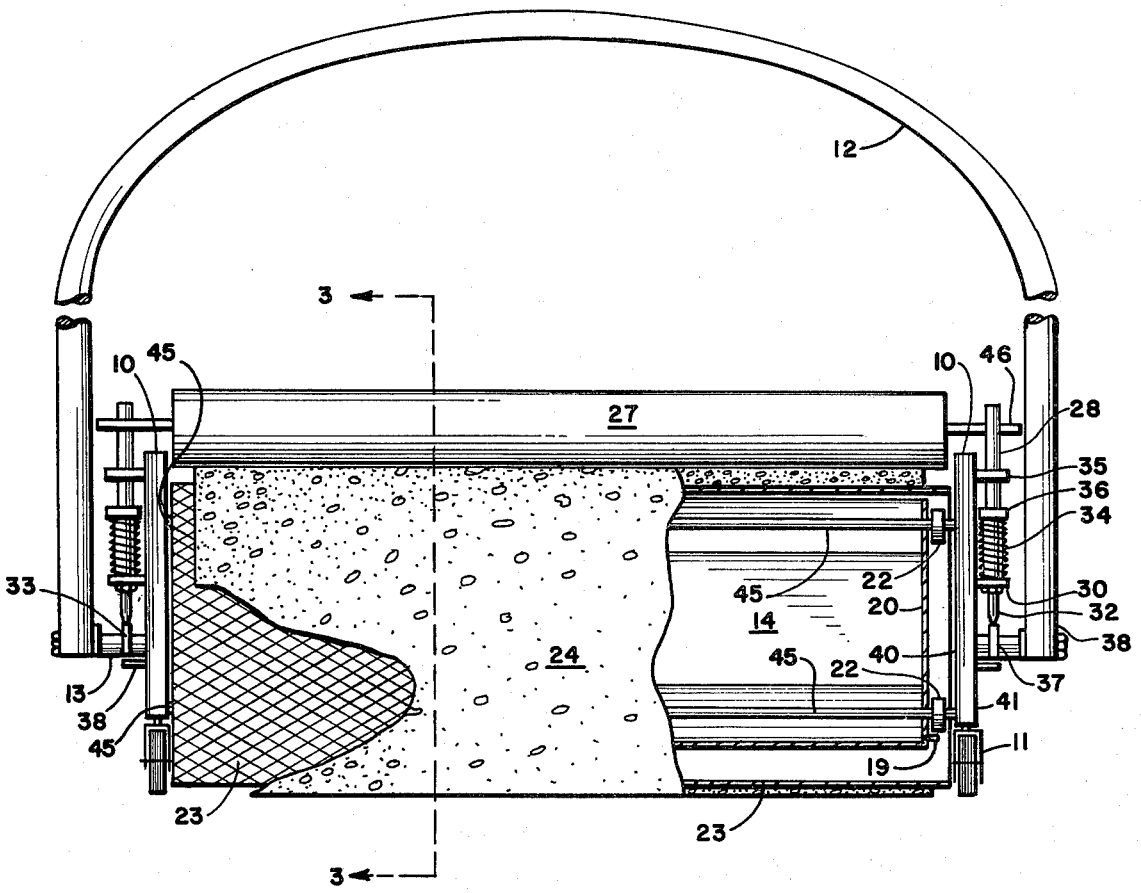
FIG. 2 is a front view of the device of FIG. 1, partly in section, with parts broken away to reveal details of internal structure.
Figure 3:
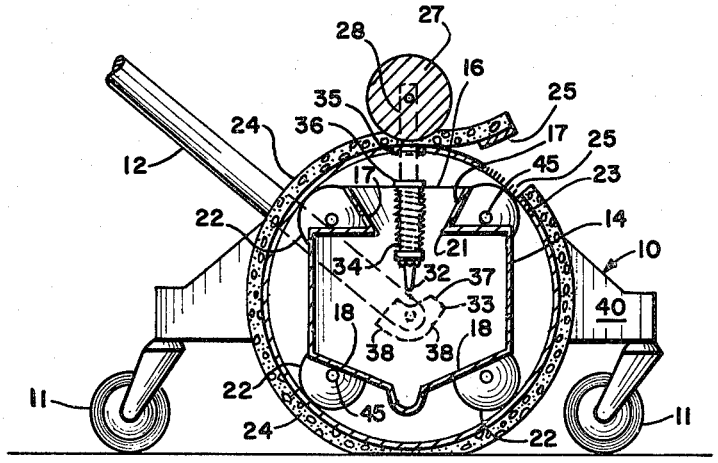
FIG. 3 is a sectional side view taken along the line 3—3 of FIG. 2.

Referring to FIGS. 1-3, an embodiment of the device of this invention is shown having carriage means comprised of (a) side members represented by plates 10 having inner faces 40 and outer faces 41, (b) caster wheels 11 pivotably engaging the opposed lower extremities of said side plates, (c) handle 12 having a generally U-shaped configuration, the lower extremities of which engage the outer faces 41 of said side plates by way of pivot posts 13 which are positioned substantially on the vertical bisector of said side plates and protrude horizontally therefrom, and (d) spanning means in the form of transverse rods 45 which extend between side plates 10 in attachment with inner faces 40 thereof. The carriage means constitutes a manually operable rolling support which enables the device to be pushed or pulled over a reasonably flat ground surface. The pivoted nature of the handle obviates the need to turn the device in the course of back-and-forth traversals of the device across a playing surface. Other advantages of the pivoted handle will be shown hereinafter. The four caster wheels are disposed in a rectangular array and are of equal height, thereby providing supportive rolling movement upon a flat surface. The side plates of the exemplified embodiment are symmetrically configured with respect to a vertical plane 15 that bisects both side plates and includes the centers of pivot posts 13.

Collecting vessel 14 is of elongated configuration and symmetrically disposed about plane 15. As best shown in FIG. 3, the upper extremity of said vessel is provided with a mouth opening 16 and associated inwardly inclined walls 17 forming a funnel-type structure, and constricted throat 21 entering the interior of vessel 14. The bottom panels 18 of vessel 14 are likewise inwardly inclined, their purpose being to facilitate drainage of water toward stoppered drain port 19 located in the lowermost portion of one horizontal extremity of said vessel. End walls 20 of said vessel are of substantially identical configuration and vertically disposed to the axis of elongation of said vessel. The collecting vessel is supported by transverse rods 45. In alternative embodiments of the invention, side plates 10 may serve as the end walls of the vessel, in which case the vessel functions additionally as spanning means, and obviates the need for transverse rods 45. Because of the novel contour of said vessel, any water contained therein is not likely to splash upwardly and out of the vessel by virtue of water movement caused by motion of the device. It is also to be noted that the funnel-shaped mouth increases the efficiency of collection of water supplied from overhead, as will be shown hereinafter.

Four identical idler wheels 22 are mounted upon transverse rods 45 adjacent inner face 40 of side plates 10. Said idler wheels are centered in a circular locus and uniformly spaced within said locus. In other equivalent embodiments of the invention three, or more than four idler wheels may be similarly disposed in a circular locus. The circular peripheries of the idler wheels associated with a given end plate are subsantially centered in a plane which is perpendicular to said plane of symmetry. In certain embodiments, the idler wheels may be rotatively mounted to the inner faces 40 of the side plates. The idler wheels are preferably provided with ball or roller bearings to facilitate rotation. The peripheries of the idler wheels may be provided with a layer of resilient material.

An apertured rigid circular cylindrical drum 23 is rotatively supported by the idler wheels. The drum is preferably fabricated of a strong, corrosion resistant material such as aluminum. The size and frequency of the apertures or perforations of the drum are such as to facilitate free passage of water through the drum without weakening it to the point where it becomes resilient. It is to be noted that drum 23 surrounds collecting vessel 14.

A porous resilient absorbent material 24 is disposed about the periphery of drum 23. The absorbent material may be comprised of an open-celled foam structure fabricated of materials such as cellulose or polyurethane, or may be comprised of fibrous assemblies interbonded by chemical or mechanical means. The absorbent material is releasably attached to the drum preferably by means of Velcro fasteners 25 or equivalent fastening means. In view of the releasable method of attachment to the drum, worn absorbent sheets can be easily replaced. The position of the drum and associated absorbent material is such as to cause the outermost surface 26 of the absorbent material to extend slightly below the plane defined by the lowermost extremities of the four caster wheels. By virtue of its placement and properties, the absorbent material takes up water from the playing surface upon which the device rides. To ensure optimum compression of the absorbent sheet for maximum water pickup, the distance between the lowermost extremity of the drum and the plane upon which the caster wheels ride is caused to be less than half the thickness of the absorbent sheet.

An elongated squeeze roll 27 having axle 46 is rotatively supported above the absorbent sheet by journaled engagement of said axle with bearing rods 28 associated with the outer faces 41 of side plates 10. The center axis of roll 27 lies in said plane of symmetry, and is parallel to the center axis of drum 23. The squeeze roll is adapted to be forced downwardly into compressive contact with the absorbent material by means to be discussed hereinafter. The rotative motion of absorbent material 24 affixed to drum 23 causes the squeeze roll to rotate at the same linear speed but in opposite direction. Such action causes water to be squeezed out of the absorbent material at a site above the mouth opening 16 of vessel 14. Because drum 23 is of a porous construction, the liberated water freely flows by gravity effect through the drum and into vessel 14.

Bearing rods 28 are held in a vertical orientation by sliding engagement with lower collar 30 and upper collar 35 attached to the outer faces 41 of side plates 10. The lowermost extremity 32 of each bearing rod is somewhat pointed and positioned in close proximity to lift cam 33 mounted on pivot post 13. A coil spring 34 positioned about rod 28 extends between and attaches to lower collar 30 and abutment ring 36 attached to the bearing rod. The spring is under tension, and disposed in a manner in association with collar 30 and ring 36 such that the bearing rod is normally pulled downward, causing squeeze roll 27 to be in compressive contact with the absorbent sheet. When it is desired to lift the squeeze roll from the absorbent sheet, as for example when it is necessary to change the absorbent sheet, the bearing rods are caused to rise within collars 30 and 35. Such upward movement of the bearing rods is achieved by lowering the handle, an action which rotates lift cam 33 in a manner such that its peaked upper edges 37 push upwardly against the lowermost extremity 32 of the bearing rods. The upward thrust of the peaked edges 37 counteracts the downward urging of spring 34, causing upward motion of the bearing rods. Limiting means in the form of paired bolts 38 extending perpendicularly from outer faces 41 are adapted to control the extent of pivotal movement of the handle. In preferred embodiments, the extent of rotation of said handle, defined by angle A in FIG. 1, will be between 120° and 160°, said angular movement being centered about plane 15.

Bearing rod 28, collars 30 and 35, spring 34 and cam 33 function collectively as positioning means which cause squeeze roll 27 to be lifted by action of the handle when said handle is placed in its lowermost position on either side of said squeeze roll.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for removing water from a substantially flat surface comprising (a) carriage means comprised of paired spaced-apart side members each having an outer face and inner face, and each supporting two caster wheels in horizontally spaced-apart juxtaposition, and spanning means interconnecting said side members in a manner such that said caster wheels, four in total in a rectangular array, are disposed to ride upon the same plane, (b) handle means pivotably engaging each side member, (c) an elongated collecting vessel extending between the inner faces of said side members and having a configuration which is substantially symmetrical about a vertical plane containing the axis of elongation of said vessel, said vessel having a collecting opening disposed adjacent its uppermost extremity which funnels down to a narrowed throat region entering the interior of said vessel, and drain means adjacent the lowermost extremity of said vessel, (d) at least three idler wheels associated with each side member in a circular locus in a plane perpendicular to the axis of elongation of said collecting vessel, (e) an apertured rigid circular cylindrical drum rotatively mounted upon said idler wheels and enveloping said collecting vessel, (f) a porous resilient absorbent material of substantially uniform thickness releasably attached to the outer periphery of said drum, and positioned to ride upon substantially the same plane as said caster wheels, (g) an elongated squeeze roll rotatively supported by said side members in a position above said absorbent material, the axis of said squeeze roll being within the plane of symmetry of said vessel and parallel to the axis of elongation of said vessel, and (h) positioning means associated with the outer faces of said side members and interactive with said handle means to cause vertical movement of said squeeze roll, thereby causing said squeeze roll to either engage said absorbent material in a manner to exert compressive force thereupon, or disengage said absorbent material, (i) whereby, rolling moving of the device enables said absorbent material to take up water from said ground surface, and the compressive action of the squeeze roll displaces water from said absorbent material, causing said displaced water to flow by gravity into said collecting vessel.

2. The device of claim 1 wherein said handle means is capable of undergoing between about 120° and 160° of pivotable angular displacement in a vertical plane perpendicular to the axis of said vessel, said displacement being centered about the vertical plane containing the axis of said vessel.

3. The device of claim 2 wherein said handle means, when moved downwardly to its position of maximum angular displacement, interacts with said positioning means to cause said squeeze roll to disengage from said absorbent material.

4. The device of claim 1 wherein a coil spring associated with each side member urges said squeeze roll into operative contact with said absorbent material.

5. The device of claim 1 wherein said idler wheels are equiangularly disposed within said circular locus.

6. The device of claim 1 wherein said side members are of substantially flat plate configuration.

* * * * *